US007073313B1

(12) United States Patent
Mullenbach

(10) Patent No.: US 7,073,313 B1
(45) Date of Patent: Jul. 11, 2006

(54) STIRRUP MOUNTING DEVICE

(76) Inventor: William L. Mullenbach, 13175 Blue Diamond Rd., Las Vegas, NV (US) 89124

( * ) Notice: Subject to any disclaimer, the term of this patent is extended or adjusted under 35 U.S.C. 154(b) by 0 days.

(21) Appl. No.: 10/972,136

(22) Filed: Oct. 22, 2004

(51) Int. Cl.
*B68C 3/00* (2006.01)

(52) U.S. Cl. ..... 54/47; 54/48

(58) Field of Classification Search ..... 54/47, 54/48, 49; D30/142
See application file for complete search history.

(56) References Cited

U.S. PATENT DOCUMENTS

| | | | | | |
|---|---|---|---|---|---|
| 169,209 | A | | 10/1875 | Wagstaff | |
| 321,984 | A | | 7/1885 | Laughlin | |
| 396,179 | A | | 1/1889 | Taylor | |
| 608,605 | A | | 8/1898 | House | |
| 1,174,712 | A | | 3/1916 | Gunn | |
| 2,532,082 | A | | 11/1950 | Borst | |
| 3,512,339 | A | * | 5/1970 | Roberts | 54/48 |
| 4,936,081 | A | * | 6/1990 | Jones | 54/48 |
| 5,347,797 | A | | 9/1994 | Seal et al. | |
| 5,598,687 | A | | 2/1997 | Hester | |
| 5,661,957 | A | | 9/1997 | Daly | |
| 5,738,340 | A | * | 4/1998 | Brantner | 54/47 |
| 5,809,754 | A | | 9/1998 | Schulte | |
| 6,026,633 | A | | 2/2000 | Burke, Jr. | |
| 6,173,558 | B1 | | 1/2001 | Burke, Jr. | |
| 6,216,427 | B1 | | 4/2001 | Cupp | |
| 6,220,004 | B1 | | 4/2001 | Hsi-Chang | |
| 6,336,626 | B1 | * | 1/2002 | Zucchini | 54/48 |
| 2003/0051448 | A1 | * | 3/2003 | Johnson | 54/48 |

OTHER PUBLICATIONS

Page 161 showing advertising for E-Z UP Stirrup Extender and p. 163 showing advertising for Legsaver swivel stirrup mount from Jul. 2003 issue of Western Horseman Magazine.

* cited by examiner

*Primary Examiner*—Teri Pham Luu
*Assistant Examiner*—Elizabeth Shaw
(74) *Attorney, Agent, or Firm*—Thorpe North & Western

(57) ABSTRACT

A stirrup extending device includes a frame slidable in a housing and having a stirrup attachment bar outside of the housing. The frame can be slid partially into the housing to move the stirrup attachment bar toward the housing to a retracted position and partially out of the housing to move the stirrup attachment bar away from the housing to an extended position. The housing is mounted in the normal saddle stirrup strap loop with the stirrup attachment bar extending below the stirrup strap loop. A stirrup is mounted to the stirrup attachment bar with appropriate mounting brackets to provide a nonrotatable connection, a partially rotatable connection, or a fully rotatable connection not available in prior art stirrup extenders, where the stirrup is free to rotate with respect to the stirrup attachment bar. The frame can be made as a single piece and assembled as a single piece into the housing as two housing sections are brought together to form the housing. This makes fabrication of parts and assembly of the parts easier and cheaper than in similar prior art devices.

18 Claims, 7 Drawing Sheets

STIRRUP MOUNTING DEVICE

BACKGROUND OF THE INVENTION

1. Field

The invention is in the field of stirrups for saddles.

2. State of the Art

Stirrups extend from a saddle to provide support for the feet of a rider mounted in the saddle. The stirrup height in relation to the saddle is adjusted to fit a particular rider with the adjustment depending upon the length of the rider's legs. Stirrups are usually mounted on a saddle by looped stirrup straps mounted to opposite sides of the saddle and hanging down from the saddle to mount the stirrups. Stirrups are normally adjusted to fit a rider by unbuckling the stirrup strap, tightening or loosening the stirrup strap to raise or lower the stirrup to the desired stirrup height, and then rebuckling the strap to support the stirrup at the desired height. This adjustment usually requires the rider to dismount the animal and remain on the ground adjacent the animal and saddle mounted on the animal to be able to unbuckle and rebuckle the stirrup strap. If available, a person standing on the ground can adjust the stirrup height for a rider with the rider mounted in the saddle. Since stirrup adjustment is not easily done, and is particularly difficult to do when mounted in the saddle, once adjusted, it is preferred to maintain the set adjustment until another rider uses the saddle.

In addition to the main function of a stirrup to support a rider mounted in the saddle during riding, stirrups are also used by the rider in mounting the animal to be ridden. To do this, the rider, when standing on the ground next to the animal to be ridden, raises a foot and places the foot in the stirrup, and, using the support provided by the stirrup, raises himself or herself to a position substantially standing on the one foot in the stirrup, swings the other foot over the saddle, and sits in the saddle. However, with the stirrups adjusted to the proper height for riding, often the stirrups are not easily reached by a rider's foot from the ground. This is particularly true for a short rider with a full size animal such as a horse, or for taller riders with a tall animal, such as a tall horse. The rider cannot reach the stirrup from the ground with his or her foot to be able to mount the animal. Older riders who cannot stretch and reach as far with their feet as when younger have a similar problem reaching their leg up into the stirrup. In such instances, it is necessary to have another person available to boost the rider up to a height where the rider can place a foot into the stirrup, or provide a support for a rider to stand on to be able to reach the stirrup.

As indicated, the stirrup is usually mounted to the saddle by a looped stirrup strap. This strap is usually leather, has a width, and is arranged to hang down from the saddle with the width of the strap parallel to the saddle and to the animal. The stirrup is usually mounted in the strap loop by a shaft parallel with the foot support which causes the stirrup to hang with the foot support also parallel to the animal, i.e., with the foot receiving opening facing outwardly from the animal. This requires the rider, once the horse is mounted, to turn or twist the stirrup into riding position thereby twisting the leather stirrup strap so that the stirrup foot receiving opening faces toward the rear of the animal, not outwardly from the animal as is its normal tendency. A common practice with saddles is to form a permanent twist into the leather stirrup straps which tend to position the stirrups in riding position. However, this normally only twists the strap part of the way necessary to orient the stirrup in riding position so continuous rider twisting is still necessary to hold the stirrup in riding position. This forced twisting of the leather strap can cause ankle and knee strain for the rider. Older riders particularly may have a difficult time keeping the stirrup in a comfortable riding position without pain from the knee or ankle strain. These two problems, the difficulty in mounting the animal and the difficulty in keeping the stirrups in riding orientation, can combine to make riding difficult, uncomfortable, and sometimes impossible for older individuals.

Several devices exist to remedy one or the other of these two problems but not to simultaneously address both problems. A stirrup extender device currently being sold by E-Z Up Stirrup Extender Co., Inc. of Las Vegas, Nev. under the Trademark E-Z UP STIRRUP EXTENDER has a housing which is positioned in and secured to the stirrup strap loop of a saddle with which the device is to be used and has a stirrup attachment bar extending from the housing for attaching the stirrup through a metal bracket attached to the bar which accepts the standard stirrup mounting shaft. A release button on the extender device allows the stirrup attachment bar to drop down a preset distance, such as about three inches, from a retracted position where the stirrup is at riding height to an extended position which lowers the stirrup. This allows most riders to be able to reach a stirrup that the rider otherwise has trouble reaching. The rider mounts the animal with the stirrup in extended position, and when in the saddle, pulls the stirrup and attached attachment bar upwardly with his or her toe to lock the stirrup in the retracted position which is the normally adjusted riding position for that rider. The rider can dismount with the stirrup in the retracted position or can easily reach down from the saddle to ankle position of a foot to push the release button to release the stirrup to the extended position for dismount. The housing is formed of two housing sections with one housing section having guide grooves formed therein through which arms extending from the attachment bar are passed in assembling the device. An upper connecting bar joins the upper ends of the arms through an open area in the housing so the upper connecting bar stops downward travel of the stirrup attachment bar when the upper connecting bar reaches the lower end of the open area. In assembling the device, the arms extending from the stirrup attachment bar are threaded through the guide grooves, and after threading the arms through the guide grooves, the upper attachment bar is secured to the upper ends of the arms to extend through the open area between the arms. The housing sections are then secured together. This requires expensive assembly work to thread the arms through the slots, to then attach the arm joining piece, and then assemble the housing. It should also be noted that the addition of the attachment bar below the stirrup strap and the metal stirrup mounting bracket below the attachment bar locate the actual stirrup attachment below the bottom of the stirrup strap rather than at the bottom of the stirrup strap as is normally the case. Thus, the stirrup strap must be adjusted at a higher setting to provide the same riding stirrup height than with the usual stirrup attached directly to the stirrup strap.

Other stirrup extending devices are shown, for example, in U.S. Pat. Nos. 6,026,633, 6,173,558, 5,809,754, 5,661,957, and 5,347,797.

A rotatable stirrup device which allows a stirrup to be coupled to a stirrup strap and allows the stirrup to freely rotate in relation to the stirrup strap and saddle between a mounting orientation and riding orientation is currently being sold by Legsaver Stirrup Company of Roosevelt, Utah under the trademark LEGSAVER. A bracket receives the stirrup shaft and is rotatably mounted by a pivot pin to a generally C shaped mounting arm that holds a mounting shaft that is mounted in the stirrup strap loop in the manner that the stirrup shaft normally is. This device is designed to mount to the stirrup strap, which is adjusted to hold the device and the attached stirrup at a desired riding height. No height extension is provided for. Again, the addition of the attachment bracket to the stirrup shaft, the provision of the pivot pin which rotatably secures the attachment bracket to the mounting arm assembly, with washers around the pivot pin between the attachment bracket and the mounting arm assembly, result in the stirrup attachment being located below the bottom of the stirrup strap rather than at the bottom of the stirrup strap as is normally the case. Thus, the stirrup strap must be adjusted at a higher setting to provide the same riding stirrup height than with the usual stirrup attached directly to the stirrup strap.

Other stirrup mounting devices that allow rotation of the stirrup in relation to the stirrup strap are shown in U.S. Pat. Nos. 169,209, 321,984, 396,179, 608,605, 1,174,712, 2,532,082, 5,598,687, and 6,220,004.

SUMMARY

According to the invention, a stirrup extending device includes a housing having a rear section and a front section secured together to capture a frame slidably therein and to form guiding grooves for receiving and guiding movement of the frame with respect to the housing. The frame includes a stirrup attachment bar outside the lower end of the housing which moves toward the housing as the frame slides in one direction with respect to the housing to a retracted position and away from the lower end of the housing as the frame slides in the opposite direction with respect to the housing to an extended position. The housing is mounted on a saddle, such as in the stirrup strap loop hanging down from the saddle, and the stirrup attachment bar mounts a stirrup and positions the stirrup at riding height in the retracted position. In extended position, the stirrup is lowered to position it nearer the ground to make it easier for a rider to reach the stirrup with his or her foot to mount the animal to be ridden. A locking apparatus locks the frame with respect to the housing when in retracted position to lock the stirrup at riding height, and releases the frame when desired to slide it to its extended position lowering the stirrup. The frame may be a single piece or preassembled piece and the device is easily assembled by inserting the frame between the front and rear housing sections as the two housing sections are attached. In one embodiment of the invention, a stirrup is mounted to the stirrup attachment bar by passing the normal stirrup mounting shaft through a mounting bracket secured directly to the stirrup attachment bar. The shaft receiving opening in the mounting bracket can be configured to allow a small amount, such as about fifteen degrees, of rotation of the stirrup with respect to the mounting bracket. In a second embodiment of the invention, the stirrup mounting shaft is secured to a mounting bracket that is rotatably mounted to a transition block secured to the stirrup attachment arm. In this embodiment, the stirrup is free to rotate with respect to the housing and stirrup attachment arm.

With the arrangements of the invention, the stirrup mounting device housing is mounted in the usual stirrup strap loop extending from the saddle with the stirrup strap extending around the lower end of the housing between the lower end of the housing and the stirrup attachment bar. The stirrup attachment bar is positioned close to the bottom of the stirrup strap loop when the stirrup attachment bar is in retracted position in the housing. The stirrup itself is then mounted either in a stirrup mounting bracket secured directly to the stirrup attachment bar, or in a stirrup mounting bracket pivotally secured to a transition block directly secured to the stirrup attachment bar. In either case, with the stirrup attachment bar in retracted position, the vertical displacement of the stirrup below the end of the stirrup strap loop in which the stirrup would normally be mounted is relatively small, generally no more than about four inches even with the rotatable mount, so the stirrup strap can be easily adjusted for proper riding height of the stirrup even with short legged riders, such as children.

BRIEF DESCRIPTION OF THE DRAWINGS

In the accompanying drawings, which show the best modes currently contemplated for carrying out the invention.

DETAILED DESCRIPTION OF THE ILLUSTRATED EMBODIMENT

Figure 1:
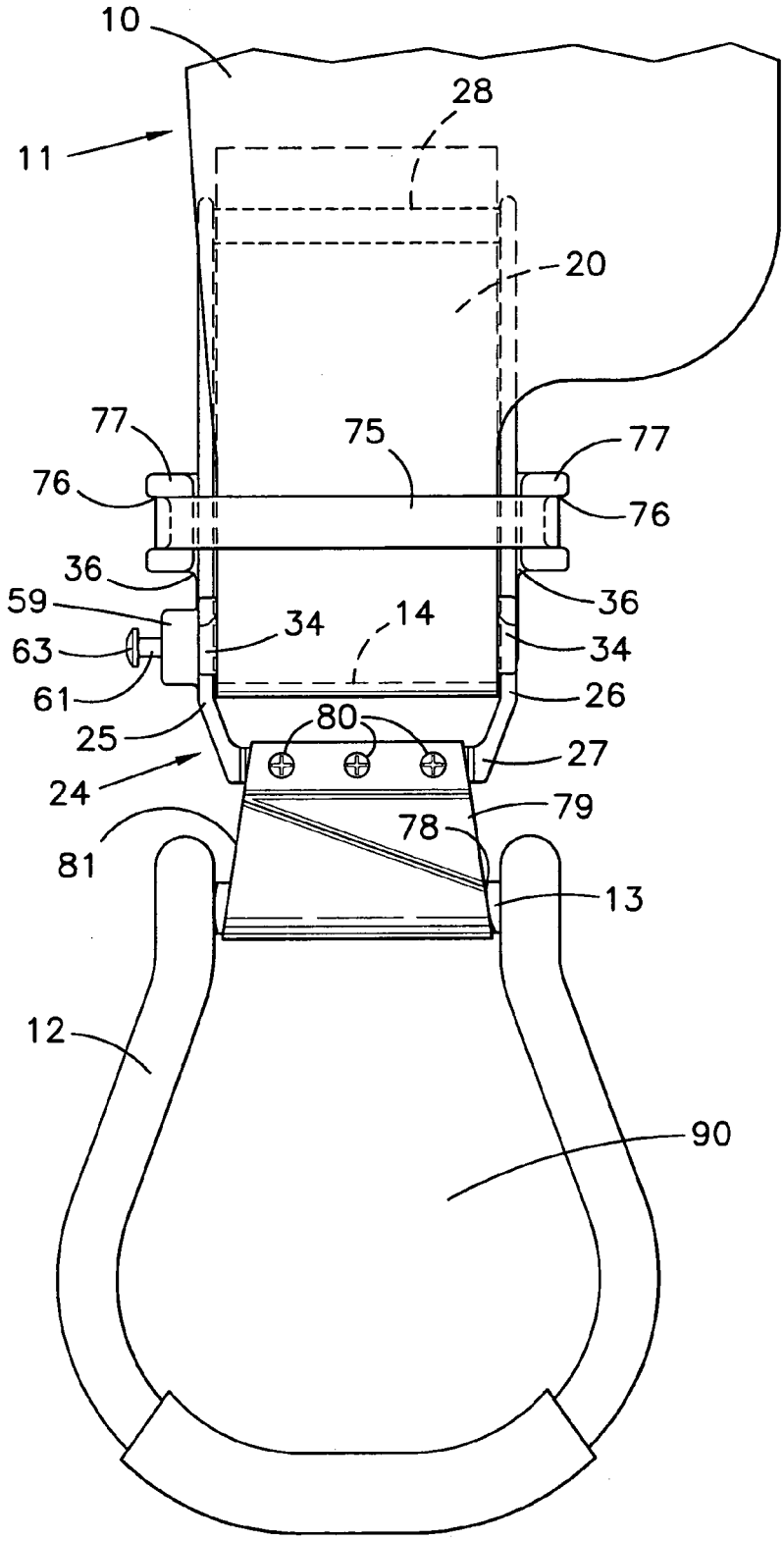
FIG. 1 is a side elevation of the device of the invention mounted in a stirrup strap loop, shown only partially, extending from a saddle, not shown, and showing the stirrup in retracted position.
Figure 2:
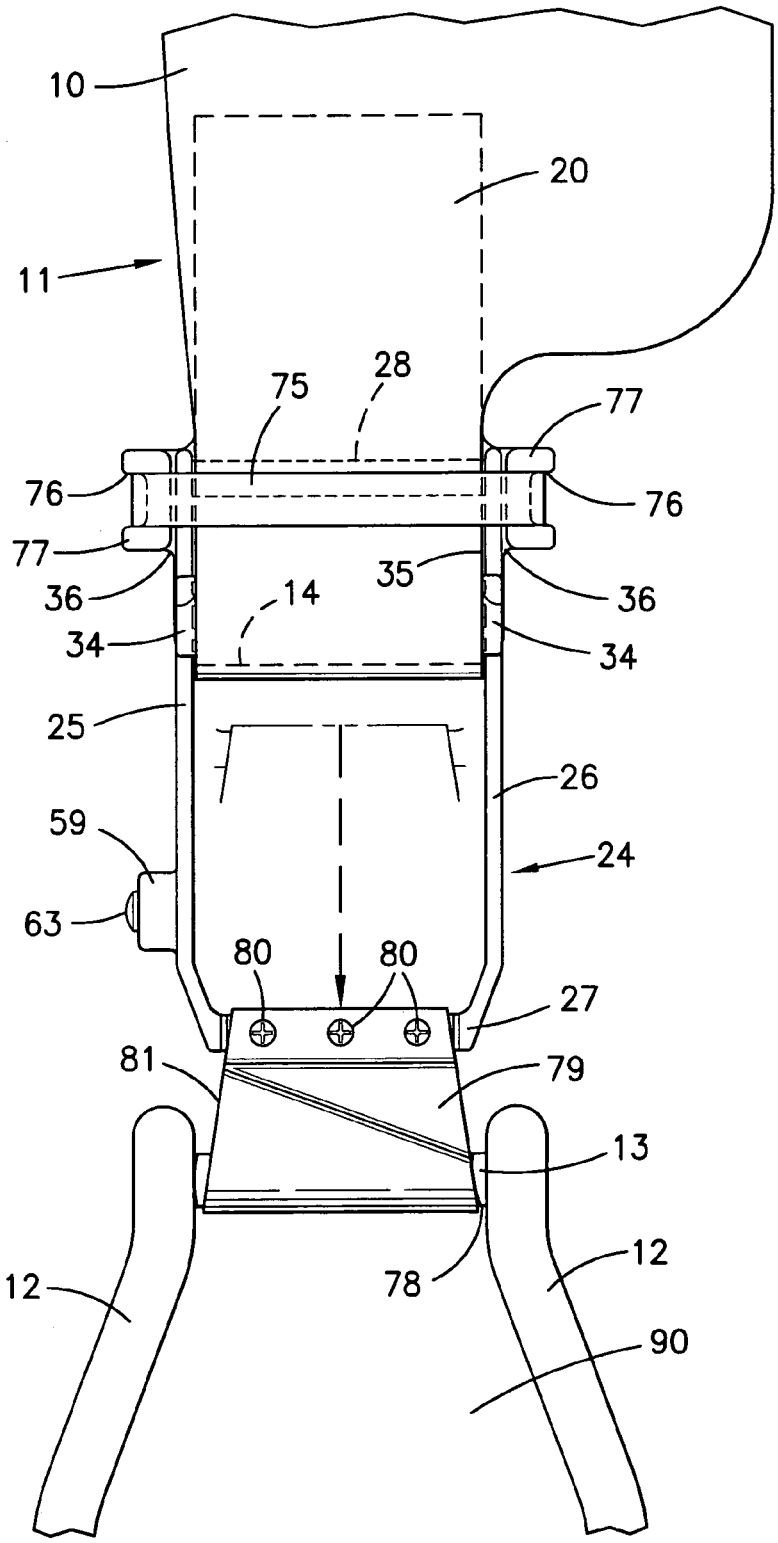
FIG. 2, a side elevation similar to that of FIG. 1, but showing the stirrup in extended position.

FIGS. 1 and 2 show the device of the invention mounted on a western type saddle, not shown, that has the usual stirrup strap 10 extending downwardly in loop formation from the saddle to form a stirrup strap loop 11. For normal attachment, not shown, of the stirrup 12 to the saddle, stirrup mounting shaft 13 is passed through the bottom 14 of the stirrup strap loop 11. The stirrup 12 then hangs directly from the bottom of the stirrup strap loop 11. The stirrup strap 10 is similar to a belt with a buckle, not shown, so that the length of the stirrup strap loop 11 is adjusted by unbuckling the stirrup strap, tightening or loosening the stirrup strap to increase or decrease the size of the loop, and rebuckling the strap when the desired size loop is formed. Increasing the size of the loop 11 extends the bottom 14 of the loop downwardly, thus lowering the stirrup, and decreasing the size of the loop 11 moves the bottom 14 of the loop upwardly, thus raising the stirrup. The stirrup strap is adjusted to raise or lower the stirrup to the desired stirrup riding height for the rider.

In addition to the main function of a stirrup to support a rider mounted in the saddle during riding, stirrups are also used by the rider in mounting the animal to be ridden. To do this, the rider, when standing on the ground next to the animal to be ridden, raises a foot and places the foot in the stirrup, and, using the support provided by the stirrup, raises himself or herself to a position substantially standing on the one foot in the stirrup, swings the other foot over the saddle, and sits in the saddle. In many instances, when the stirrup is set at the correct riding height for a particular rider, the stirrup is too far off the ground for that rider, standing on the ground, to reach the stirrup with his or her foot. In such cases, it is convenient to be able to lower the stirrup for mounting the animal without changing the riding adjustment of the stirrup. The device of the invention allows the stirrup to be lowered to help the rider mount the animal to be ridden and then to be easily raised to riding height and locked in riding height position for riding.

Figure 3:
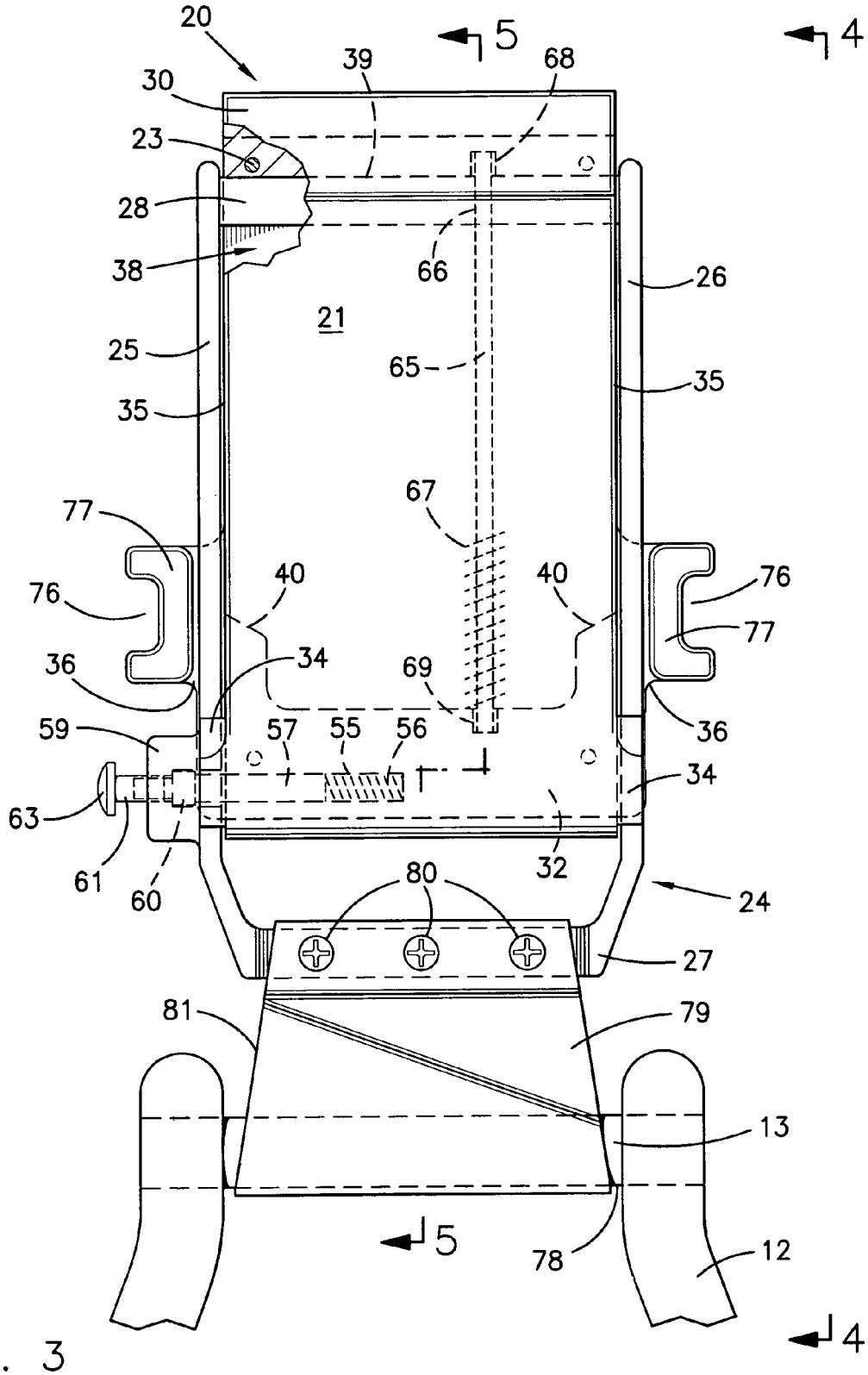
FIG. 3, a side elevation of the device of the invention similar to that of FIG. 1, but enlarged and removed from the stirrup strap loop, showing internal parts in broken lines and showing only the top of the stirrup.
Figure 4:
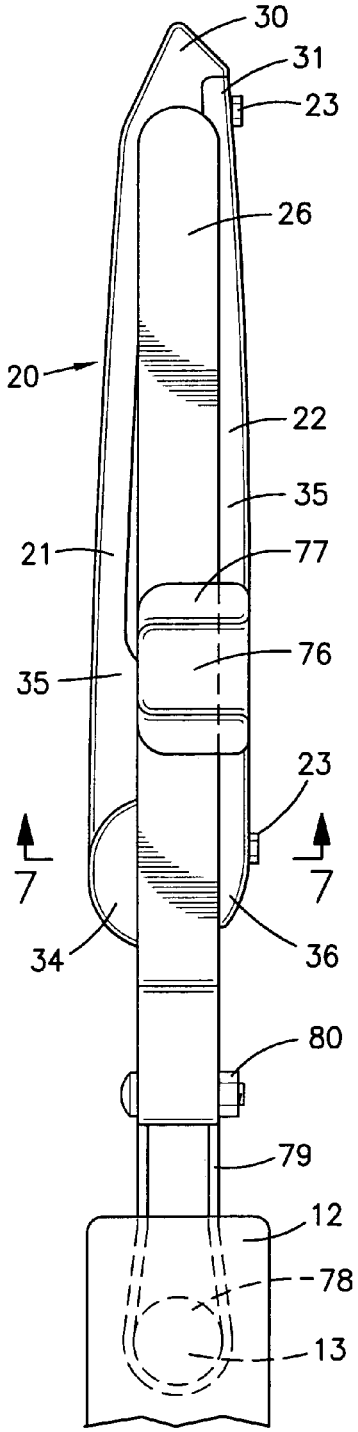
FIG. 4, a side elevation of the device of FIG. 3, taken on the line 4—4 of FIG. 3.
Figure 5:
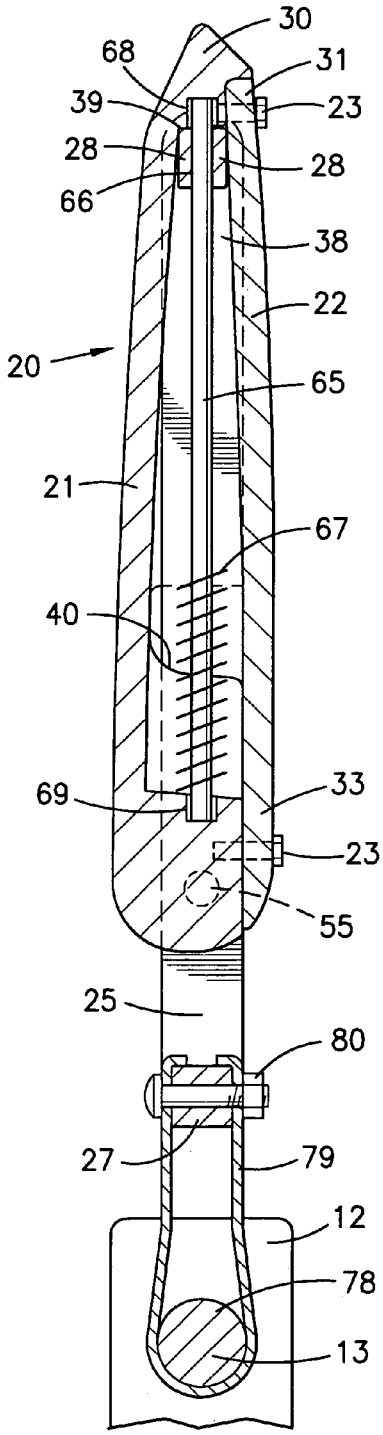
FIG. 5, a vertical section of the device of FIG. 3, taken on the line 5—5 of FIG. 3.
Figure 6:
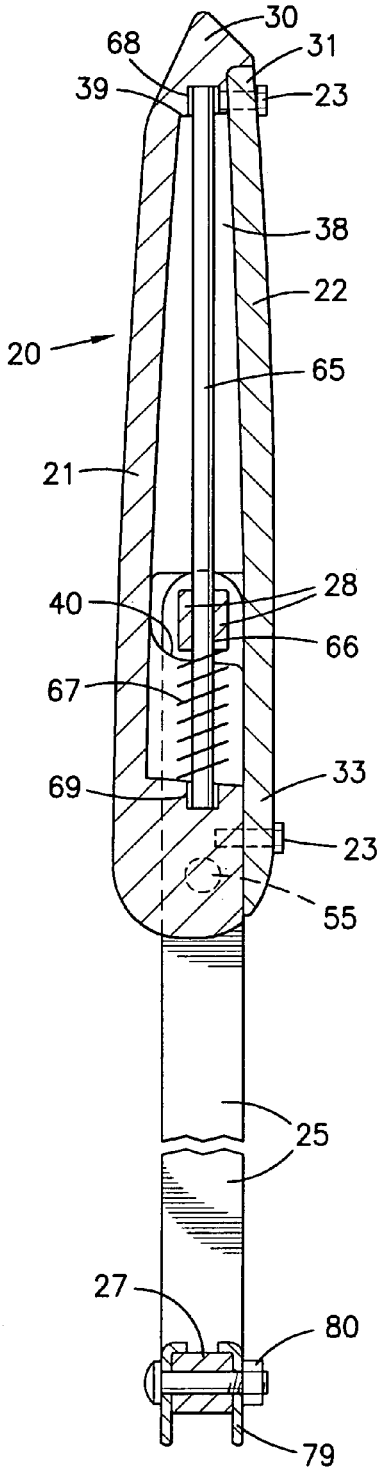
FIG. 6, a vertical section similar to that of FIG. 5, but showing the stirrup in extended position.
Figure 7:
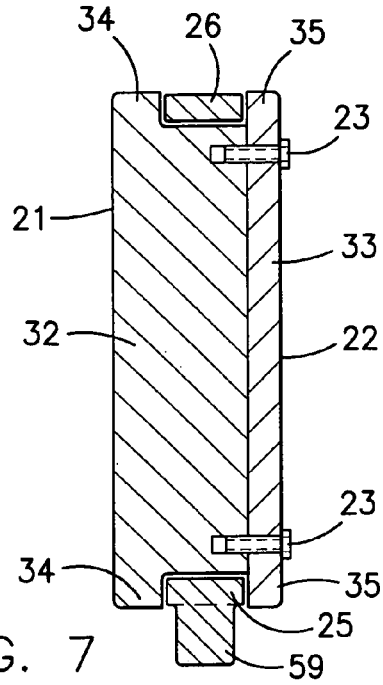
FIG. 7, a transverse section taken on the line 7—7 of FIG. 4.

The device of the invention includes a housing 20 formed from front housing section 21 and rear housing section 22, best seen in FIGS. 4, 5, and 6, secured together by screws 23 to capture a sliding frame 24. Frame 24 includes opposite, substantially parallel side members 25 and 26 rigidly joined in spaced relationship at their bottom ends by stirrup attachment bar 27. Upper frame members extend inwardly into the housing from the upper ends of side members 25 and 26. Preferably, as shown, the upper frame members take the form of a single upper connecting bar 28 connecting the upper ends of the frame side members 25 and 26, although a bar connecting the upper ends of the side members is not necessary and the upper frame members can merely be tabs or stubs extending inwardly from each arm. Front housing section 21 has an upper end mating portion 30 that mates with an upper end mating portion 31 of the rear housing section. Similarly, front housing section 21 has a lower end mating portion 32 which mates with lower end mating portion 33 of the rear housing section. Front housing section lower mating portion 32 includes side tabs 34 extending outwardly beyond front housing section side walls 35, and rear housing section lower mating portion 33 has tabs 36 extending outwardly beyond front housing section side walls 35. When the front and rear housing sections are secured together, the outwardly extending tabs 34 and 36, in combination with front housing side walls 35 which space tabs 34 and 36, form frame receiving and guiding channels on opposite sides of the lower mating portions 32 and 33 for slidingly receiving and guiding the side members 25 and 26 of the frame, see particularly FIG. 7. The front and rear housing sections 21 and 22, when secured together, also form an open area 38, FIGS. 5 and 6, extending through the housing between the front and rear housing sections and between the upper and lower mating portions. Upper connecting bar 28 passes through this open area 38 and can slide up and down within this open area 38 between the upper mating portions and the lower mating portions. The lower edge 39 of the front housing section upper mating portion 30 acts as a stop for upper connecting bar 28 and defines the retracted position of the frame in the housing. Similarly, the uppermost edges 40 of the front housing section lower mating portion 32 form stops for upper connecting bar 28 as it travels downwardly and defines the maximum extended position of the frame in the housing. Thus, the frame is captured by the housing when the housing is assembled with stirrup attachment bar 27 outside and below housing 20, frame side members 25 and 26 captured between tabs 34 and 36, and upper connecting bar 28 captured between housing sections 21 and 22 in open area 38. With this assembled arrangement, the frame can be slid up and down with respect to the housing to move stirrup attachment bar 27 toward housing 20 to a retracted position as shown in FIGS. 1, 3, 4, and 5, and away from housing 20 to an extended position as shown in FIGS. 2 and 6.

Figure 11:
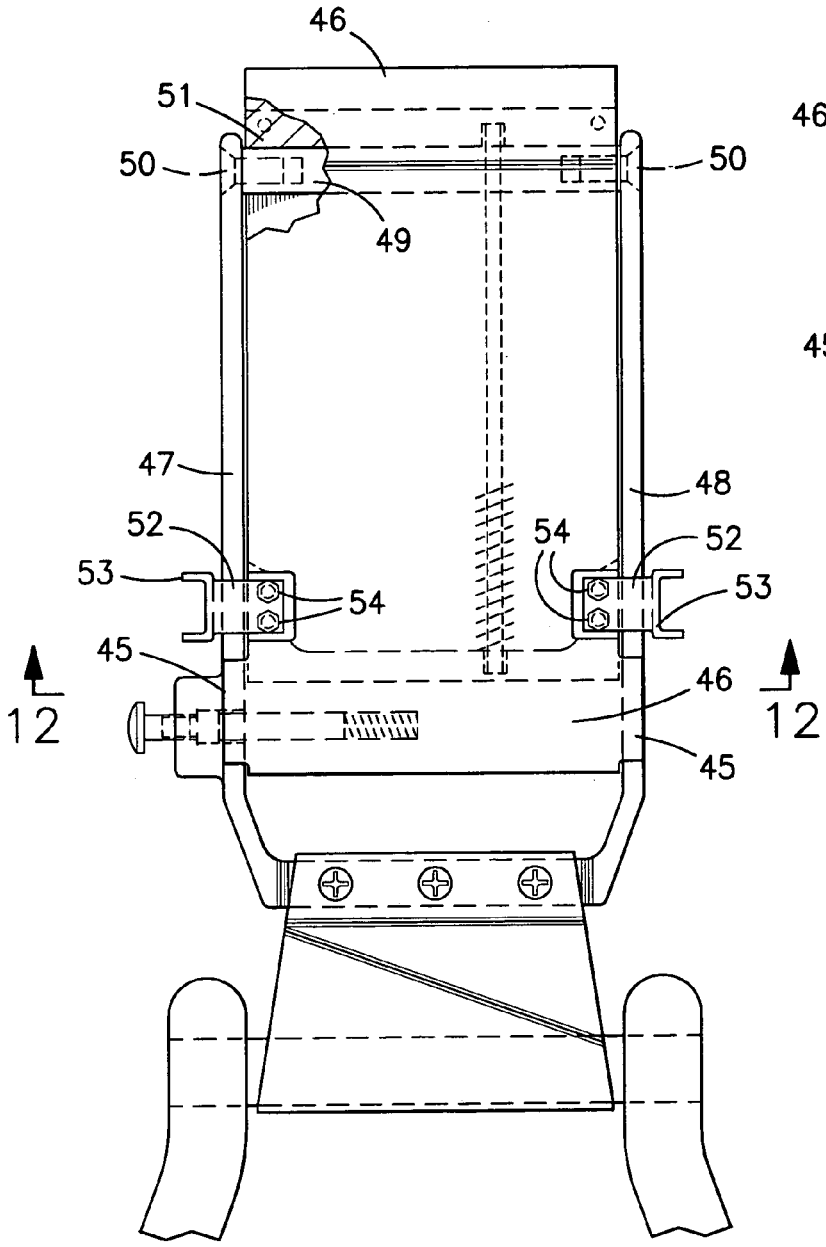
FIG. 11 PRIOR ART
FIG. 11, a front elevation of a prior art E-Z UP stirrup extender device.
Figure 12:
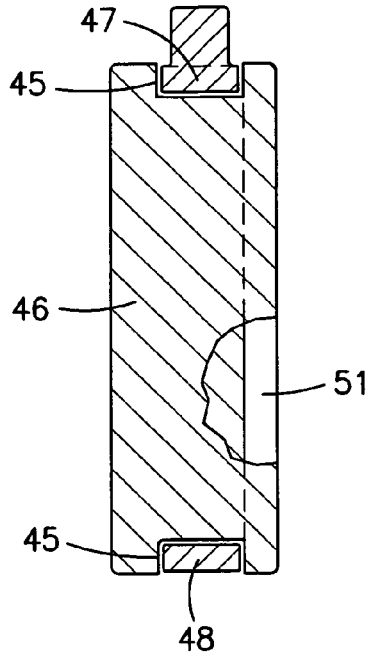
FIG. 12 PRIOR ART
FIG. 12, a transverse section similar to that of FIG. 7, taken on the line 12—12 of FIG. 11 and rotated ninety degrees clockwise showing the prior art device of FIG. 11.

The construction described above differs from the prior art construction of the E-Z UP stirrup extender in that the prior art E-Z UP stirrup extender shown in FIGS. 11 and 12, has the frame side member receiving and guiding channels 45 formed entirely in the front housing section 46. This requires machining or special casting techniques to form these channels 45 and requires that the frame, during assembly of the device, be open at its upper end so the side members 47 and 48 can be threaded through the channels 45. Once the side members 47 and 48 are threaded through channels 45 in front housing section 46, upper connecting bar 49 is secured to and between the upper ends of side members 47 and 48, such as by screws 50, and the rear housing section 51 is secured to the front housing section 46 to capture upper connecting bar 49 therebetween. In addition, once the housing is assembled, separate clips 52, which are U shaped, not shown, to fit over the front and rear surfaces of the housing, and have an additional U shaped configuration 53 on their outer end for accepting a securement strap when the housing is mounted in a stirrup strap loop, are positioned along the edge of the housing and over the side members and are attached to the housing by bolts 54 which extend through the assembled front and rear sections of the housing. The described assembly of the prior art E-Z UP requires several time consuming manipulation and assembly steps which adds to the expense and time of assembly. With the construction of the present invention, the frame can be provided as a single piece casting or as an otherwise prefabricated fully assembled part which is merely set on the front housing section 21 with side members 25 and 26 resting on tabs 34 and upper connecting bar 28 resting on front housing section 21 between the upper and lower mating portions 30 and 32, and rear housing section 22 then secured to front housing section 21. No special forming of the side member receiving and guiding channels in one of the housing sections is required as such channels are formed when the housing sections are assembled. Further, the attachment strap guides are cast onto the rear housing as will be described. Thus, several time consuming assembly steps are eliminated with the present invention.

Figure 8:
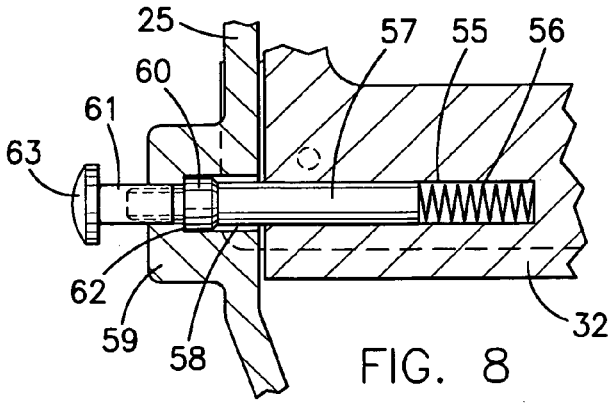
FIG. 8, a fragmentary vertical section of the locking apparatus showing the locked retracted position of the stirrup attachment bar.
Figure 9:
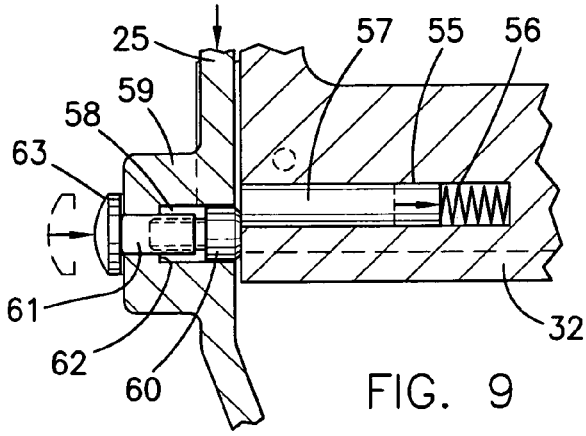
FIG. 9, a fragmentary vertical section of the locking apparatus similar to that of FIG. 8, but showing the unlocked position of the stirrup attachment bar as it begins to move to extended position.

Since the stirrup must be held in riding position during riding of the animal, and the stirrup is in riding position when the frame and its stirrup attachment bar is in retracted position, it is necessary to be able to lock the frame in retracted position during riding. For this purpose a locking apparatus is provided. A bore 55 is formed in the front housing section lower mating portion 32, FIGS. 3, 8, and 9, with a spring 56 in the bottom of the bore and a locking pin 57 in the bore. Spring 56 biases locking pin 57 outwardly from the bore against frame side member 25. A locking pin receiving hole 58 through frame side member 25 and lock release tab 59 preferably formed integrally with side arm 25 is positioned in frame side member 25 to be aligned with hole 55 when the frame is in retracted position as shown in FIGS. 3 and 8. In retracted position, locking pin 57 is biased into locking pin receiving hole 58 to lock the frame in retracted position. Locking pin 57 also pushes enlarged end 60 of locking release button shaft 61 outwardly until enlarged end 60 abuts against shoulder 62 in hole 58. When it is desired to allow the frame and stirrup attachment bar 27 to move to extended position, lock release button 63 is pressed inwardly to move enlarged end 60 on lock release button shaft 61 against locking pin 57 in hole 58 to push locking pin 57 against the bias of spring 56 out of locking pin receiving hole 58 to thereby release the frame so it can slide to extended position, see FIG. 9.

It will generally be preferred to provide some cushioning to the frame when dropped into extended position. For this purpose, rod 65 extending through a receiving hole 66 in upper connector bar 28, and having spring 67 positioned on the lower portion thereof, can be positioned between front housing section upper mating portion 30 and front housing section lower mating portion 32, such as by placing the ends of the rod 65 in receiving openings 68 and 69 as shown in FIGS. 3 and 5. With this arrangement, when the frame is released from retracted position and falls downwardly under the influence of gravity into extended position, the fall is cushioned by spring 67 before upper connecting bar 28 hits the upper edges 40, FIG. 3, of the front housing section lower mating portion 32.

In use, housing 20 is positioned in stirrup strap loop 11, FIGS. 1 and 2, with the housing bottom at the bottom 14 of the loop. When initially installed, the stirrup strap is unbuckled and an end passed between the bottom of the housing 20 and the stirrup attachment bar 27 so that with housing 20 positioned in stirrup strap loop 11, stirrup attachment bar 27 is positioned below stirrup strap loop 11, as shown in FIG. 1. A securement strap 75 is wrapped around stirrup strap loop 11 and through strap receiving indentations 76 in strap receiving tabs 77 extending from the sides of housing 20, here shown as extending from the tabs 36 of the rear housing section 33, to securely hold housing 20 in stirrup strap loop 11. Stirrup mounting shaft 13 is positioned in a preformed cylindrical receiving opening 78 in stirrup mounting bracket 79 and stirrup mounting bracket 79 is secured to stirrup attachment bar 27 by bolts 80. The length of stirrup strap loop 11 is then adjusted to position stirrup 12 at the proper riding height for the rider. Because stirrup 12, which with normal mounting to the saddle positions stirrup mounting shaft 13 at the bottom 14 of the stirrup strap loop 11, is mounted below the bottom of stirrup strap loop 11 a distance equal to the distance of the bottom of stirrup mounting bracket 79 below the bottom of stirrup strap loop 11, the stirrup strap loop 11 will have to be adjusted to raise the bottom of the loop to place the stirrup, which is now mounted below the bottom of the stirrup strap loop 11, at proper riding height. When desired to mount the animal for riding, the rider pushes lock release button 63 to release the frame from retracted position in the housing and the frame with stirrup attachment bar 27 and stirrup 12 mounted thereto drops down to extended position, as shown in FIGS. 2 and 6. With the device shown, the stirrup will generally drop about three inches into extended position, although this distance will depend upon the various dimensions of the device. The rider then mounts the animal and with his or her toe, lifts the extended stirrup upwardly until it locks in retracted position. When the rider finishes riding and wants to dismount, the rider can reach down and press lock release button 63 to allow the stirrup to fall to extended position to ease the rider's dismount. Cylindrical receiving opening 78 in stirrup mounting bracket 79 may be tapered to an enlarged cylinder diameter end 81 to allow some rotational movement of the stirrup mounting shaft 13 in the cylindrical receiving opening 78 to allow some rotational movement of the stirrup mounting shaft 13 and stirrup 12 with respect to the stirrup mounting bracket 79. Such tapered enlargement may be sized to provide up to about fifteen degrees of rotation to the stirrup.

Figure 10:
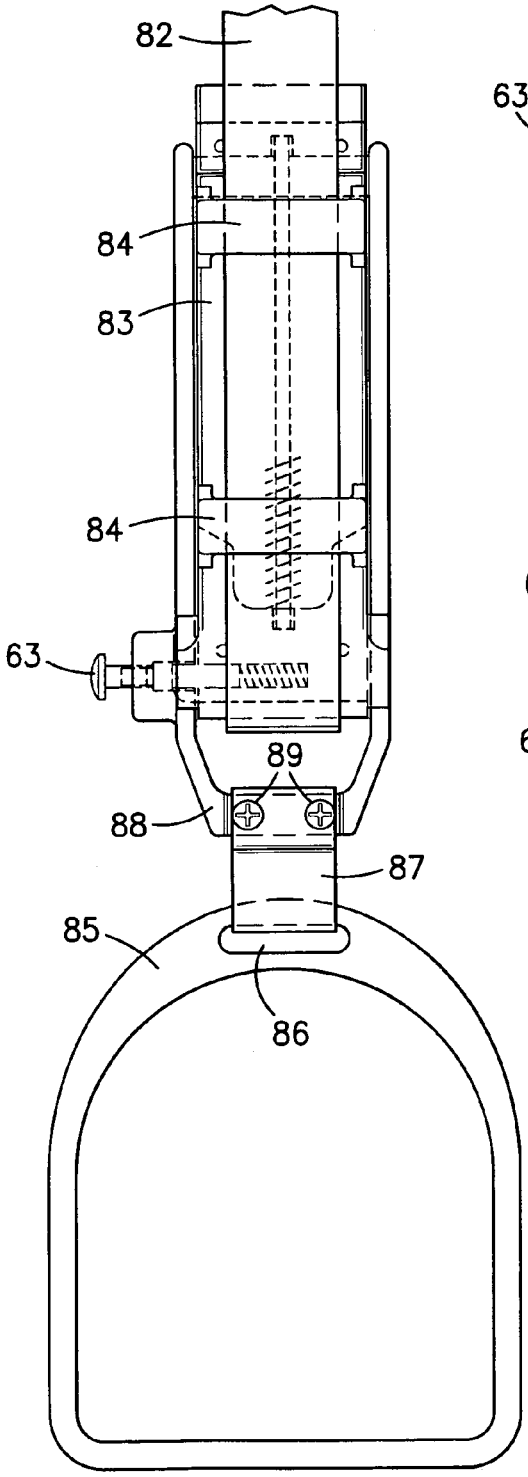
FIG. 10, a front elevation of an embodiment of the invention for use with English saddles.

FIG. 10 shows a device of the invention specifically sized to fit an English saddle which has a narrower stirrup strap 82 extending from the saddle and forming the stirrup strap loop. The construction, assembly, and operation of the device is substantially identical to that described above, except for the size and configuration of the parts. Further, rather then securing the housing in the stirrup strap loop with additional securing strap 75, front housing section 83 has rigid stirrup strap loops 84 formed thereon through which the stirrup strap 82 is threaded to secure the housing to the strap loop. English style stirrup 85 includes mounting opening 86. Stirrup mounting bracket 87 extends through mounting opening 86 and is secured to stirrup attachment bar 88 with bolts 89.

As seen in FIGS. 1 and 2, when a stirrup 12 is mounted to the stirrup strap loop 11, either with the traditional mounting of the stirrup directly to the stirrup loop or with the device of the invention, the stirrup and the foot receiving opening 90 of the stirrup is aligned with the flat surface of the stirrup strap. The usual construction of a saddle results in the flat surface of the stirrup strap being aligned with the longitudinal axis of the animal on which the saddle is mounted so that the foot receiving opening 90 is normally oriented so a foot is inserted transversely to the longitudinal axis of the animal. During riding, the foot receiving opening 90 should be oriented so the foot inserted into the stirrup is approximately aligned with the longitudinal axis of the animal. With the normal saddle mounting of the stirrup strap, the rider must twist the stirrup strap to turn the stirrup to proper riding alignment. This places stress on a rider's knees and ankles as the rider continually twists the stirrup strap during riding. The extent of twisting necessary varies because the stirrup strap is given, or through use, acquires a permanent twist. The addition of the extender device of the invention as described above does not change the stirrup orientation so the rider still has to twist the stirrup strap and stirrup to properly align the stirrup for riding. As described, the stirrup mounting bracket 79 can be configured with an enlarged, tapered preformed cylindrical receiving opening 81 for the stirrup mounting shaft 13 to allow some rotational movement of the stirrup with respect to the stirrup strap, but such rotational movement is limited.

Figure 14:
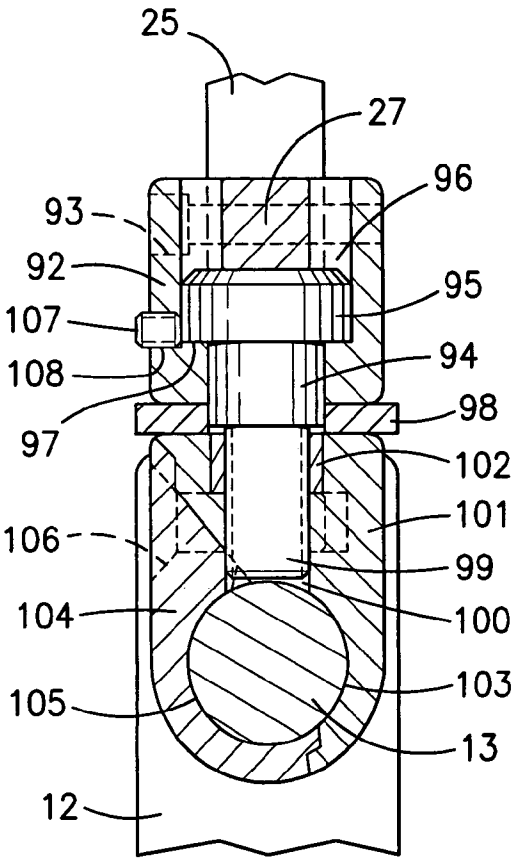
FIG. 14, a vertical section taken on the line 14—14 of FIG. 13.
Figure 13:
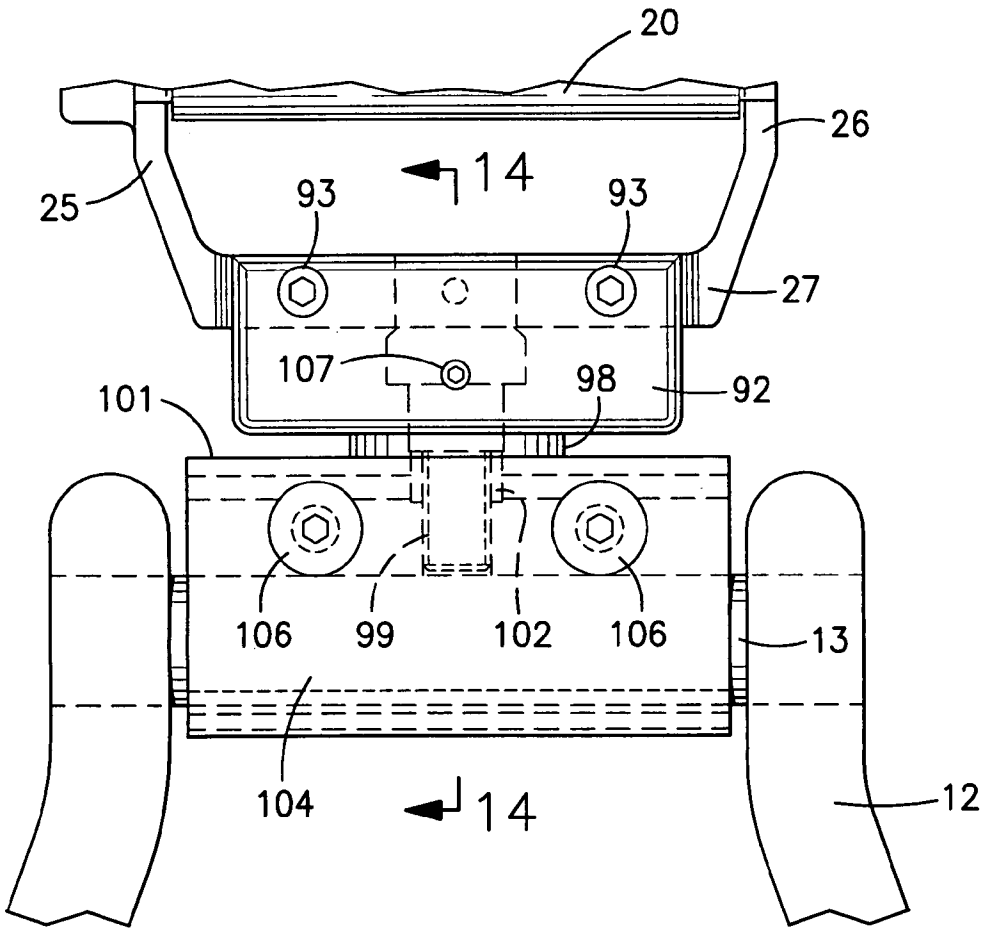
FIG. 13, a fragmentary front elevation of an embodiment of the invention providing a fully rotatable mounting of the stirrup to the stirrup attachment bar.

One aspect of the invention is the provision of a pivoted mounting of the stirrup to the stirrup attachment bar of the extender device so that the device provides for free rotation of the stirrup. To provide for such rotation, a transition block 92, FIGS. 13 and 14, is secured to stirrup attachment bar 27 by screws 93. Pivot pin 94 with head 95 is positioned in receiving hole 96 with head 95 resting on shoulder 97 in receiving hole 96, and extends from the bottom of transition block 92, through lubricating washer 98, to securement of pivot pin threaded end portion 99 in receiving hole 100 in stirrup mounting bracket portion 101. A threaded steel insert 102 can be positioned in receiving hole 100 if mounting bracket portion 101 is made of a material, such as aluminum or plastic, which does not hold threads well. Stirrup mounting shaft 13 is positioned in partial longitudinal bore 103 extending through mounting bracket portion 101, and mounting bracket portion 104 with mating partial bore 105 is secured to mounting bracket portion 101 by screws 106 to complete and close a longitudinal bore around stirrup mounting shaft 13, thereby mounting stirrup mounting shaft 13 and stirrup 12 therein. The mounting bracket formed by mounting bracket portions 101 and 104, along with stirrup 12 mounted therein, is free to rotate to any desired degree with pivot pin 94 rotating in hole 96. Washer 98 acts to separate transition block 92 from stirrup mounting bracket portion 101 to prevent interference with relative rotation of the two and to provide lubrication to ease rotation. Washer 98 is preferably made of a plastic material, such as nylon, to promote relative rotation. The described mounting arrangement provides a fully rotatable, secure mounting of the stirrup to the extension device with a minimum of mounting hardware and with a minimum extra extension of the stirrup below the stirrup strap loop when in retracted, riding position. The extra extension is generally no more than about four inches. This allows the stirrup strap to be easily adjusted for proper riding height of the stirrup even with short legged riders, such as children.

A set screw 107 is provided in threaded receiving bore 108 in transition block 92 to be tightened against pivot pin head 95 if it is desired to lock the stirrup in a certain rotated position with respect to transition block 92. Tightening set screw 107 against pivot pin head 95 will prevent rotation of the stirrup.

Whereas the invention is here illustrated and described with reference to embodiments thereof presently contemplated as the best mode of carrying out the invention in actual practice, it is to be understood that various changes may be made in adapting the invention to different embodiments without departing from the broader inventive concepts disclosed herein and comprehended by the claims that follow.

The invention claimed is:

1. A stirrup mounting device comprising:

a frame having opposite, substantially parallel, longitudinal side members each having a lower end and an upper end, a stirrup attachment bar extending between and rigidly joining the lower ends of the opposite longitudinal side members in spaced relationship, and upper frame members extending inwardly from the upper ends of the side members;

a rear housing section having an upper end mating portion and a lower end mating portion;

a front housing section secured to the rear housing section to form a device housing capturing the frame, said front housing section having an upper end mating portion adapted to mate with the upper end mating portion of the rear housing section and a lower end mating portion adapted to mate with the lower end mating portion of the rear housing section when the front and rear housing sections are secured together to form the device housing, the lower end mating portions cooperating to form opposite side receiving and guiding grooves for slidingly capturing the opposite side members of the frame inserted between the housing sections prior to the housing sections being joined, and forming a receiving area between the rear housing section and the front housing section between the upper end mating portions and the lower end mating portions for capturing the upper frame members therein and allowing sliding movement of the frame with respect to the housing to allow the stirrup attachment bar to move toward the housing to a retracted position and away from the housing to an extended position; and locking apparatus for locking the frame in retracted position and releasing the frame to allow the frame to slide to extended position.

2. A stirrup mounting device according to claim 1, wherein the upper frame members constitute a single upper connecting bar extending between and connecting the upper ends of the frame side members, and the receiving area between the upper end mating portions and the lower end mating portions of the housing for receiving the upper frame members therein is an open area between the rear housing section and the front housing section to allow the upper connecting bar to slide therein.

3. A stirrup mounting device according to claim 2, wherein the frame is a single piece.

4. A stirrup mounting device according to claim 3, wherein the frame is a single cast piece.

5. A stirrup mounting device according to claim 4, additionally including a stirrup mounting bracket secured to the stirrup attachment bar and mounting a stirrup thereto.

6. A stirrup mounting device according to claim 5, wherein the stirrup mounting bracket receives a standard stirrup mounting shaft therein to mount the stirrup.

7. A stirrup mounting device according to claim 6, wherein the stirrup mounting bracket allows a limited amount of rotational movement of the stirrup mounting shaft therein.

8. A stirrup mounting device according to claim 7, wherein the limited rotational movement of the stirrup mounting shaft in the stirrup mounting bracket is about fifteen degrees of rotation.

9. A stirrup mounting device according to claim 4, additionally including:

a transition block secured to the stirrup attachment bar; and a stirrup mounting bracket rotatably mounted to the transition block and adapted to have a stirrup mounted thereto, whereby the stirrup mounting bracket and a stirrup mounted thereto can rotate with respect to the device housing.

10. A stirrup mounting device according to claim 9, wherein a pivot pin extends between the transition block and the stirrup mounting bracket to rotatably mount the stirrup mounting bracket to the transition block.

11. A stirrup mounting device according to claim 10, additionally including a lubricating washer positioned around the pivot pin between the transition block and the stirrup mounting bracket.

12. A stirrup mounting device according to claim 1, additionally including:

a transition block secured to the stirrup attachment bar; and a stirrup mounting bracket rotatably mounted to the transition block and adapted to have a stirrup mounted thereto, whereby the stirrup mounting bracket and a stirrup mounted thereto can rotate with respect to the device housing.

13. A stirrup mounting device according to claim 12, wherein a pivot pin extends between the transition block and the stirrup mounting bracket to rotatably mount the stirrup mounting bracket to the transition block.

14. A stirrup mounting device according to claim 13, additionally including a lubricating washer positioned around the pivot pin between the transition block and the stirrup mounting bracket.

15. A stirrup mounting device according to claim 1, wherein the locking apparatus includes a locking pin bore in one of the lower end mating portions oriented substantially perpendicular to a frame side member captured in the housing, a locking pin slidingly received in the locking pin bore, a spring received in the locking pin bore to bias the locking pin outwardly from the locking pin bore against the frame side member, a locking pin receiving opening in the frame side member positioned to be aligned with the locking pin when the frame is in retracted position in the housing, and a release button on the frame side member to push the locking pin out of the locking pin receiving opening in the side member against the bias of the spring to release the frame to allow it to move to its extended position.

16. A stirrup mounting device comprising:

a device housing adapted to be mounted in the stirrup strap loop extending from a saddle;

a frame slidably mounted in the housing for movement of the frame with respect to the housing to cause a stirrup attachment bar to move toward the housing to a retracted position and away from the housing to an extended position;

locking apparatus for locking the frame in retracted position and releasing the frame to allow the frame to slide to extended position;

a transition block secured to the stirrup attachment bar; and a stirrup mounting bracket rotatably mounted to the transition block and adapted to have a stirrup mounted thereto, whereby the stirrup mounting bracket and a stirrup mounted thereto can rotate with respect to the device housing.

17. A stirrup mounting device according to claim 16, wherein a pivot pin extends between the transition block and the stirrup mounting bracket to rotatably mount the stirrup mounting bracket to the transition block.

18. A stirrup mounting device according to claim 17, additionally including a lubricating washer positioned around the pivot pin between the transition block and the stirrup mounting bracket.

* * * * *